United States Patent [19]

Wood

[11] 3,972,092

[45] Aug. 3, 1976

[54] MACHINE FOR FORMING FIBER WEBS

[75] Inventor: Dennis E. Wood, Penfield, N.Y.

[73] Assignee: Rando Machine Corporation, Macedon, N.Y.

[22] Filed: Nov. 26, 1974

[21] Appl. No.: 527,379

Related U.S. Application Data

[63] Continuation-in-part of Ser. No. 337,019, March 1, 1973, abandoned.

[52] U.S. Cl. ..... 19/156.3; 19/89

[51] Int. Cl.[2] ..... D01G 25/00

[58] Field of Search ..... 19/88, 89, 156, 156.4, 19/155; 156/62.2; 425/80

[56] References Cited

UNITED STATES PATENTS

| | | | |
|---|---|---|---|
| 2,876,500 | 3/1959 | Buresh et al. | 19/89 |
| 2,890,497 | 6/1959 | Langdon et al. | 19/156.3 X |
| 3,435,484 | 4/1969 | Langdon | 19/156.4 X |
| 3,512,218 | 5/1970 | Langdon | 19/156.3 |
| 3,535,187 | 10/1970 | Wood | 19/156.4 X |
| 3,717,905 | 2/1973 | Furbeck | 19/156.3 X |
| 3,744,091 | 7/1973 | Wood | 19/156.3 |
| 3,753,217 | 8/1973 | McBean | 19/156.3 |
| 3,768,120 | 10/1973 | Miller | 19/156.3 |

FOREIGN PATENTS OR APPLICATIONS

| | | | |
|---|---|---|---|
| 1,172,561 | 10/1958 | France | 19/89 |
| 688,216 | 2/1940 | Germany | 19/89 |
| 893,686 | 4/1962 | United Kingdom | 19/156.4 |

*Primary Examiner*—Dorsey Newton
*Attorney, Agent, or Firm*—Shlesinger, Fitzsimmons & Shlesinger

[57] ABSTRACT

In this machine, tufts of fibers are delivered from a feed section by an air bridge into a generally vertical chute past a rotary feeder condenser on which the fibers are formed into a mat which is carried onto a feed plate over which the mat is fed by a feed roller into a lickerin rotating at high speed. The lickerin, which is vertically below the condenser, combs fibers from the mat. The fibers are doffed from the lickerin through centrifugal force and by an air stream flowing past the lickerin. The air stream conveys the fibers through a generally vertical duct to an endless belt screen condenser on which they are deposited to form the random fiber web. The air is recirculated past the lickerin to aid in doffing the fibers from the lickerin.

8 Claims, 8 Drawing Figures

MACHINE FOR FORMING FIBER WEBS

This application is a continuation-in-part of my application Ser. No. 337,019, filed Mar. 1, 1973, now abandoned.

The present invention relates to machines for forming random fiber webs, and more particularly to such machines in which a fiber mat is fed to a rotating lickerin, which combs individual fibers from the mat; and the fibers are doffed from the lickerin by centrifugal force and by an air stream flowing tangentially past the lickerin, and the doffed fibers are carried in suspension in the air stream to a moving foraminate condenser, on which the fibers are deposited in random fashion to form the random or non-woven fiber web. The webs are suitable for producing high quality non-woven fabrics by known chemical or mechanical bonding treatments.

Because the duct between the lickerin and the condenser is generally horizontal, prior machines of the type described are generally horizontal in their major direction, and occupy considerable floor space. If a fiber feeder is attached to the web forming machine, as is generally the case nowadays in practice, the amount of floor space occupied by the combination feeder-webber is quite considerable; and floor space is expensive.

Non-woven fabrics are produced from web structures by chemically bonding or by mechanically interlocking the fibers together. The dry formed structures may be chemically bonded by known means such as the application of adhesives by spray or by saturation, also bonding may be accomplished by the use of fibers which have a low melting point and form a bond to nonadhesive fibers by heat and pressure. Mechanical bonding may be carried out by needling, or stitch bonding may be used; also apertured or print bonding may be used to provide strength and durability. The quality of any non-woven fabric produced by these finishing methods depends upon the quality and uniformity of the web structure which is to be treated or finished.

Webs suitable for producing random non-woven web structure have been prepared by aerodynamic formation apparatus such as manufactured by Rando Machine Corporation and known as "Rando-Webbers" and disclosed in U.S. Pat. Nos. 2,451,915, 2,700,188, 2,890,497, 3,535,187, 3,512,218 and 3,768,119.

Non-woven web structures formed by aerodynamic means are normally produced by opening and blending various fibers to separate the fibrous mass into individual fibers. The opened fibers are formed into a uniform feed mat. The opening and the formation of the feed mat are extremely important to the final web structure since any non-uniformity or poor opening will cause unwanted irregularities in the final product.

The uniform feed mat is fed via a toothed or clothed feed roll to a similarly covered lickerin, and a stream of air is caused to move over the surface of this lickerin by either a positive or negative air pressure. The lickerin is rotated at high speed to feed or comb the fibers from the feed mat into the air stream, the objective being to feed individual fibers rather than clumps or group of fibers. The fibers are carried in the machines of the present invention by the high velocity air stream as a dilute dispersion downwards through a vertical conduit to a condensing screen surface moving at right angles to the flow in the vertical path, and are deposited over a relatively large surface area to form a random structure on the moving screen.

The primary object of the present invention is to provide an aerodynamic process and apparatus suitable for high speed production of uniform webs of excellent quality from uniform feed mats made of fibrous materials.

Another object of the present invention is to provide a web forming machine which will be more compact than prior such machines, and which will occupy a minimum of floor space.

Another object of the invention is to provide a combination fiber feeder and webber, which together will be much more compact than prior such combinations.

Other objects of the invention will be apparent hereinafter from the specification and from the recital of the appended claims, particularly when read in conjunction with the accompanying drawings.

Figure 1:
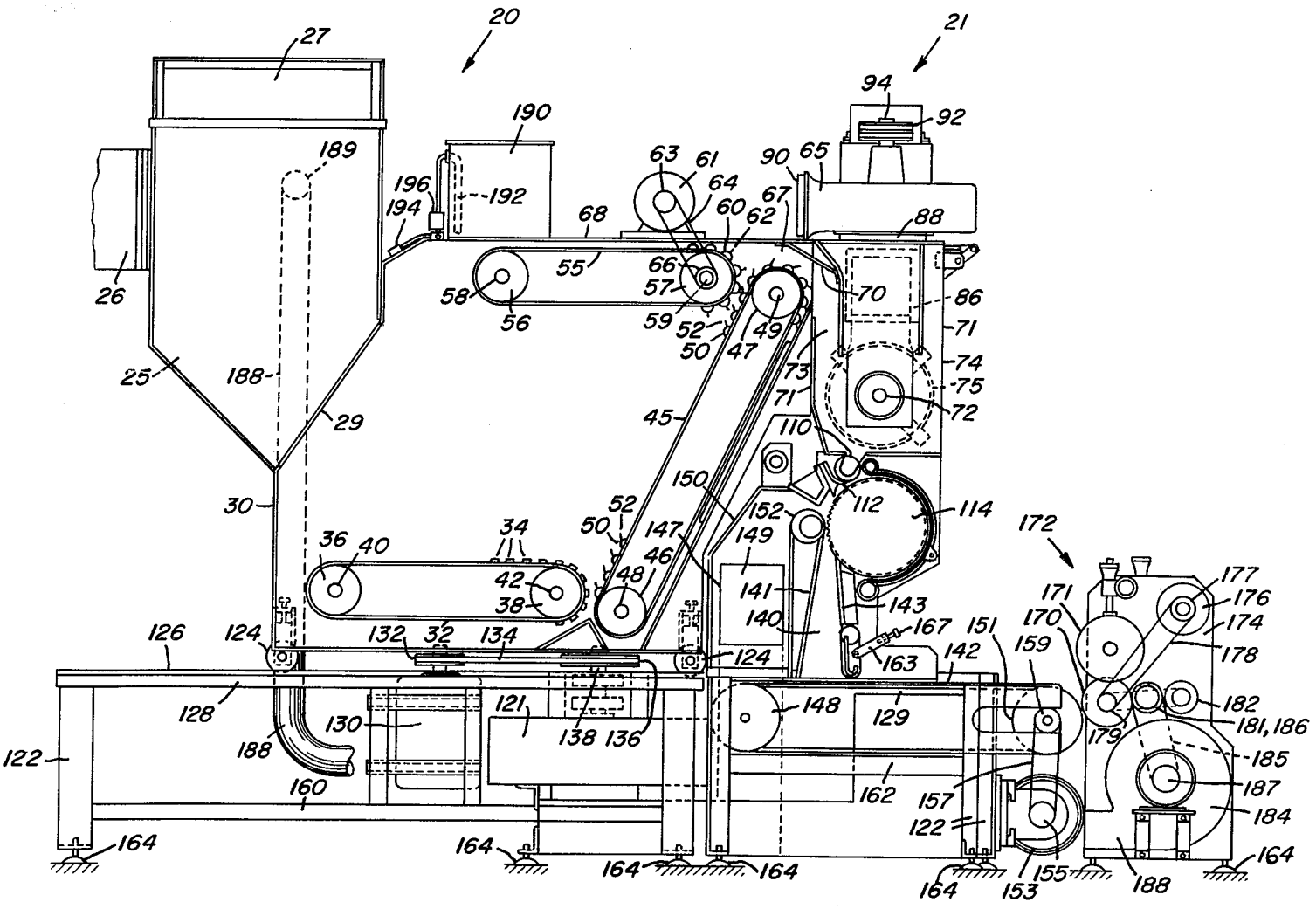
FIG. 1 is a somewhat diagrammatic vertical sectional view of a combination fiber feeding and web forming machine built according to one embodiment of this invention.

The present invention is an improvement in forming webs of fibrous material over the apparatus disclosed in U.S. Pat. No. 3,768,119 and U.S. application Ser. No. 337,019, by dispersing fibers in a flow of air or gas which acts in a downwards direction acting with the pull of gravity and then, collecting the fibers on a horizontal moving condenser screen whose direction is at right angles to the air and fiber flow to form a random arrangement of the fibrous web structure.

In accordance with this improvement the fibrous particles (which may be for instance, staple textile fibers or natural fibers of wool, cotton or wood) are projected at a uniform initial velocity of at least 4500 feet per minute and preferably between 10,000 and 20,000 feet per minute at a vertical or perpendicular angle to the forming screen and through an expansion chamber which is somewhat rectangular is cross-section with two walls having an angle of less than 15° and preferably less than 11° from each other and two walls having not more than 5° from their vertical and preferably 3° or less such that this expansion chamber increases in its cross-section from the lickerin to the condenser screen.

The flow of air or gas is controlled so that the fibrous particles are projected into a region of stable flow characterized immediately up stream of the fiber flow by a combination of an average velocity of the air flow (V) of between 0.25 and 1.5 times the initial fiber velocity and preferably between 0.5 and 1.2 of that velocity.

The fibers are preferably projected onto the condenser screen at a rate of between 5 and 25 pounds per hour per inch of machine width or air flow width, although the apparatus is suitable for slow and higher rates of operation. The weight rate of air flow is usually determined by the formula disclosed in the Wood U.S. Pat. No. 3,535,187 and is dependent upon the amount of fibers and their weight and size. Using this formula:

$$Q = \frac{890\ PL^2}{DK}$$

Where $Q$ = quantity of air in cfm.
$P$ = production rate in lbs./hr.
$L$ = fiber length in inches.
$D$ = denier of fiber.
$R$ = dilution factor.

the calculated amount of air to convey the fibers may be found. It is not uncommon to find that at least 20 to 30 times the weight of air, at standard conditions of density and temperature (0.075 lbs. per cu. ft. at 70°F and 29.92" Hg.) to the weight of fiber processed per unit of time must be used to convey the fibrous mass.

The air flow conditions are controlled to provide a relatively thin fibrous stream which may be less than 6 mm thick as initially formed and preferably less than 3 mm thick. The thickness of the downwards acting fiber stream increases somewhat as the flow passes through the expansion chamber but should not expand to more than 12 to 25 mm thick as it approaches the condensing surface.

The fibrous particles are given their initial velocity by the centrifugal force of the lickerin and ejected into the path of the air stream at a tangential to the lickerin and vertically downwards to the surface of the lickerin cylinder into the path of the air flow.

The surface speed of the lickerin should be at least 4500 feet per minute and the preferred surface speed for staple textile fibers is between 10 and 20,000 feet per minute, although for wood fibers speeds of 20,000 feet per minute or more may be necessary.

The feeding or supply means continuously provides a uniform supply of fiber materials into the surface of the rotating lickerin and between a closely spaced curved tail of the nose bar to hold the fiber close to the cylinder's surface until the fiber enters the air stream and is doffed from the lickerin. The fibrous material is thus projected downwards in a vertical plane into the venturi section at the upper point of the expansion chamber. The lickerin cylinder is mounted away from but adjacent to the outer wall of the expansion chamber so that a small arc of the surface of the cylinder is exposed within the air flow and forms one side of the venturi at that point.

The inlet air flow duct directs a uniform velocity, low turbulence, stable air stream, free from vorticities, in the direction of movement of the lickerin cylinder and in a downwards direction making use of gravitational pressure. The boundary layer which is formed around the surface of the lickerin is interrupted by the use of a doffing bar which is incorporated in the duct at a point of maximum shear just below the lickerin and at the start of the expansion chamber to provide a controlled low level of turbulence in the air layer through which the fibrous particles must pass.

A conventional type of lickerin cylinder having its surface covered with metallic card clothing having at least 25 points per square inch of surface area and preferably between 50 and 80 points per square inch, is suitable for combing the individual fibers from the feed mat and projecting these into the air stream. The curved smooth surface of the tail of the nose bar is arranged at a small distance from the surface of the lickerin to provide a narrow passage where the fibers are carried on the points of the wire covering or the cylinder surface to a point of projection into the venturi and high velocity air stream. The length of this curved section of the nose bar should from a sector of a circle where the center is the projected radius of the lickerin plus the clearance or passage way so that the arc is equal to $$\frac{R\pi\ \alpha^\circ}{180}$$

Where $R$ = the finished radius of the lickerin plus the passage way between the lickerin's surface and the curved wall of the tail of the nose bar.

$$\frac{(R\ \mathrm{pi}\ \alpha^\circ)}{180}$$

pi = $\pi$
$\alpha^\circ$ = the angle at the center of the lickerin subtended by the radius.

The angular distance ° should be between 15° and 40° and preferably between 17° and 37°. The clearance between the face of curved section of the nose bar tail and the tips of the lickerin cylinder's teeth should be less than 0.020 inches and preferably between 0.015 and 0.010 inch. The space between the nose bar at the point where the apex of the nose bar approaches the lickerin surface should be less than 0.012 inch and preferably between 0.007 and 0.003 inch.

The surface speed of the lickerin is from 4500 feet per minute to in excess of 20,000 feet per minute; the surface speed should be at the highest possible which does not damage the fibers being processed and the lickerin cylinder should be designed for the surface speed, and balanced for minimum vibration. The cylinder's diameter should not be too large; since the fibers are projected tangentially only a short distance before losing momentum, but a diameter of between 9 inches and 20 inches will be required to suit the required surface speed and to reduce the vibration on wide machines.

The expansion chamber provides a conduit through which a uniform velocity, low turbulence flow of air is passed adjacent to the lickerin cylinder and on to the fiber condenser screen. The expansion chamber is of a configuration such that substantially all the fibrous particles projected from the feed means are supported in the air stream which is a thin stream of less than 6 mm and preferably less than 3 mm initial thickness, the stream being kept away from layers of high turbulence, non-uniform flow, or separated flow.

Preferably the expansion chamber has a substantially rectangular cross-section. The cross-sectional area increases as the chamber approaches the condenser screen, the adverse effects of boundary layer separation by the use of a too rapidly-diverging duct is avoided by the use of the diffuser angles between the walls in the widest cross-sectional direction of less than 15 degrees and preferably less than 5 degrees from the vertical for the other two walls. The chamber should be vertical and at right angles to the condenser screen and without any curvature from the projection point to the condenser screen. The fiber flow should be centered in the expansion chamber and allowed to expand in a controlled manner to reduce the amount of kinetic energy of the particles as they approach the condensing surface.

In the preferred embodiment of the invention, the inlet air duct is connected to a conventional air or gas supply means for providing an air flow of low turbulence intensity and minimal eddies. The required air supply is normally via centrifugal fans blowing air into a highly uniform passage, which in the preferred embodiment of the invention is provided with flow distribution devices, such as vanes, perforated plates, and honeycomb sections. These devices reduce turbulence and eddies and diffuse and straighten the flow of air. Typically the air is forced through a honeycomb cell structure having a uniform cross-section. The most effective cell size is dependent upon the velocity of the air used but in a cell with a diagonal of 3/16 of an inch and a depth of some 4 inches the wall material is relatively thin. About 0.010 has been found most effective. In some instances a depth of the honeycomb section of more than 4 inches has been found useful but should not be more than 6 inches. The air passage will normally be the same width as the venturi section into which the fibers are projected and several times greater in the other cross-sectional dimension. Thus the air inlet velocity in the larger air passage in which the air straighteners and diffusers are located is much less than the smaller duct at the venturi which provides a uniform velocity across the width and depth of the inlet duct and allows an acceleration of the air, eliminating turbulence.

The velocity variation across the width of the duct at the point where the air flow advances into the venturi section and projected fiber stream should be less than ±10% and preferably less than ±5%. The average turbulence intensity or the standard deviation of the velocity variation at this point is less than 17% and preferably less than 8%. These values refer to the portion of the air stream immediately prior to the venturi section and at a point where the fibrous flow mixes with the input air flow. It has been found that if the turbulence intensities are large, large eddies or vortices are present in this region and the velocity profile is unstable and this produces an inlet flow which causes the fibrous particles to disperse in the expansion chamber and cause fluctuations and pulsations of the fiber and air flow mixture to give excessive blotchiness in the web structure. The air passing through the duct and at the venturi section should be adjusted to level the flow and reduce the turbulence and velocity distribution. This is carried out by the adjustment of the saber tube.

It has been found that web streaks or blotchiness is due to the air stream non-uniformity, its profile and vortices created at the boundary layers along the walls of the expansion chamber.

It can be shown that there exists a layer of air adjacent to the wall surface through which a variation of velocity between the fiber/air mixture and the surface is transmitted. The whole of the frictional resistance between the fibrous flow and the surface occurs in this layer. The boundary layer consists of a number of thin parallel stream bands each having a slightly higher velocity than its inner neighbor. The stream immediately adjacent to the surface of the wall is found to adhere to that surface at zero velocity. Working outwards from the surface the next stream band has an extremely small velocity; and each successive layer or band will have a slightly higher velocity than its inner neighbor until the stream is reached which has approximately full velocity of the fibrous mixture at the center of the chamber. This last stream band is the outside limit of the boundary layer and no fiber resistance is transmitted to the wall surface of the chamber beyond this outer limit provided vortices do not cause the fibers to be drawn into the turbulent flow and thus causing clumps of fibers to be created in these vortices.

The thickness of the boundary layer is important and may be calculated from the formula:

$$d = 5.83\,(l/R)^{1/2}\,\sqrt{lx}$$

where
d = boundary layer thickness
R = Reynolds Number
l = linear length of the walls surface
x = linear distance at which "d" is to be calculated.

The flow within the boundary layer may be laminar or turbulent according to the particular point from the entrance to the expansion chamber. Under some forms of flow within the apparatus the boundary layer leaves the surface and curls up into a vortex or whirlpool which is termed a separation and causes bunches of fibers to form momentarily and be swept into the web structure being formed on the condenser screen.

The thickness of the boundary layer increases with its distance from the entrance to the expansion chamber in proportion to the square root of the distance along the wall surface and also the Reynolds number of the flow.

The boundary layer is always in evidence when the fibrous flow is within the chamber and at relatively low velocities. Hence at low fiber throughputs there is no separation; but as the amount of fibers is increased, velocity separation commences at a certain point and continues until a break away of the boundary layer is caused thus forming pronounced vortices.

Within the expansion chamber it has been found that at the entrance or at a point of the start of the expension just below the venturi, the flow is laminar for a short distance. This is followed by a short length in which the flow changes from laminar to turbulent, and it is here that the flow is unstable. The length of the transition period of the layer is found to be about the same length as the laminar flow portion. After this section the boundary layer becomes very turbulent until a vortex is formed.

In this turbulent layer the transmission of momentum is made by the fibrous particles of higher velocity moving inwards and giving up their momentum by collisions and that the break away point occurs where the energy of the resistance at this section of flow cannot be absorbed fast enough by the boundary layer. Then the energy will be dissipated in the vortices so formed. This is liable to occur with short length fibers such as wood and the finer denier textile materials.

Another problem caused with the boundary layer flow is the variation of pressure within the layer. At the break away point or formation of the vortex, a flow may occur opposite in direction to the main fibrous flow so that within this reversed air current along the chamber walls surface a positive pressure may be created pulling fibrous particles into its path, thus adding to the causes of the vortex itself. It is possible to control this separation point by creating a high velocity air stream so it passes through the boundry layer as generally described in U.S. Pat. No. 3,768,119.

The transition also depends on the roughness of the walls. If the roughness is small the resulting disturbances will lie below the threshold of the separation point and will have no effect. However, when the roughness is large, the transition will occur as they are presented to the flow.

The use of the venturi section and the large air input chamber reduce the formation of random eddies. The invention overcomes formation of eddies to provide for a uniform air velocity profile across the width of the expansion chamber and the venturi section where the fibers are projected into the air stream.

In normal aerodynamic web forming equipment the web is constructed of a succession of extremely thin overlapping areas, each area having a random arrangement of the fibrous materials. These overlapping areas are normally referred to as shingle planes. The length of these shingle planes is directly proportional to the length of the forming chamber area and to the thickness of the fibrous construction. Due to the use of an angled air stream and inclined condenser screen it has been found that the quality of the fibrous arrangement deteriorates as the production speed is increased. The subject invention makes use of a concentrated high velocity stream of fibers and air which is normally about 3 cms in thickness as it approaches the condensing surface; and the fibrous materials are deposited in a succession of very small overlapping shingle planes on a horizontal screen. The spread of the fibrous formation within these planes may be accomplished by use of the variation of the air flow into the expansion chamber via the combined use of air stream diversion devices such as a saber tube and in the preferred embodiment of the invention, inlet slots at the air supply chamber and at the lickerin doffing bar area of the duct wall.

The use of various sizes of openings in the air flow distribution devices within the inlet duct also affect the structure of the fibrous web structure upon the condenser screen.

Another feature of the preferred embodiment of the invention is the provision of an inlet flow distribution device within the walls of the inlet chamber and also just below the doffing bar. These consist of a perforated plate fixed to an opening in the wall and covered with an adjustable solid cover so that the open area of the inlet may be changed to suit the fibrous web construction on the condenser screen, by allowing atmospheric air to enter the machine. The perforated plate would normally have an open area of above 42% and have a staggered hole arrangement.

Referring now to the drawings by numerals of reference, and first to FIG. 1, 20 denotes the feed section, and 21 the webbing section of a machine built according to one embodiment of this invention.

The feed section comprises a hopper 25 into which fibrous material may be fed from a conventional opener through a duct 26. A port 27 extends across the top of the hopper at one side thereof to permit escape to atmosphere of air that has been entrapped in the fibrous material.

The fibrous material flows from the hopper through opening 29 into a bin 30. The fibrous material is fed from this bin to the web-forming section of the machine. The feed mechanism shown in similar to that disclosed in the Langdon et al. U.S. Pat. No. 2,890,497, issued June 16, 1959.

This feed mechanism includes an endless floor apron or conveyor belt 32 which is mounted in the base of the bin and on which are secured a plurality of preferably wooden slats 34. The apron 32 is mounted to travel over pulleys 36 and 38 which are secured to shafts 40 and 42, respectively, that are journaled in the sides of the bin.

This apron carries the stock material from adjacent opening 29 to an endless elevating apron or conveyor 45 which is mounted to travel over pulleys 46 and 47, that are secured to shafts 48 and 49, respectively, also journaled in opposite sides of the bin 30. The elevating apron is provided with a plurality of straps 50 in which are embedded pins 52. The belt is inclined upwardly; and the pins 52 are inclined to the direction of travel of the belt. The pins 52 pick up tufts of the stock material from the floor apron 32; and they carry these tufts upwardly toward the top of the bin as the belt 45 travels upwardly.

Mounted in the upper portion of the bin to cooperate with the elevating apron 45 is an endless stripping apron 55. This apron is an endless belt which travels over pulleys 56 and 57 that are secured to the shafts 58 and 59, respectively, which are also journaled in the sides of the bin. The apron 55 carries a plurality of straps 60 in which are embedded pins 62, that are inclined to the direction of travel of the stripping apron.

The roller 57, that drives the stripper apron, may be driven from a motor 61 mounted on top of the feeder unit, through a pulley 63 on the armature shaft of the motor, the belt 64, and the pulley 66, which is mounted on the same shaft with the roller 57.

The purpose of the stripping apron 55 is to break up and reduce the tufts of material, which are carried upwardly by the pins 52 of the elevating apron, and to remove excess material from the elevating apron, and move this excess material to the loading end of the bin. The stripping apron removes excessive fiber from the pins 52 of the elevating apron, leaving only small bunches or tufts on the individual pins 52.

The tufts remaining on the pins 52 of the elevating apron are stripped from these pins by suction. A suction fan (not shown) of conventional construction mounted in a housing 65 (FIGS. 1 and 2) sucks the tufts of fibers off of the pins 52 through a duct 67 formed between the cover plate 68 of the bin and the top of the elevating apron 45 and between the walls 70 and 71 of the fiber chute 73.

Figure 2:
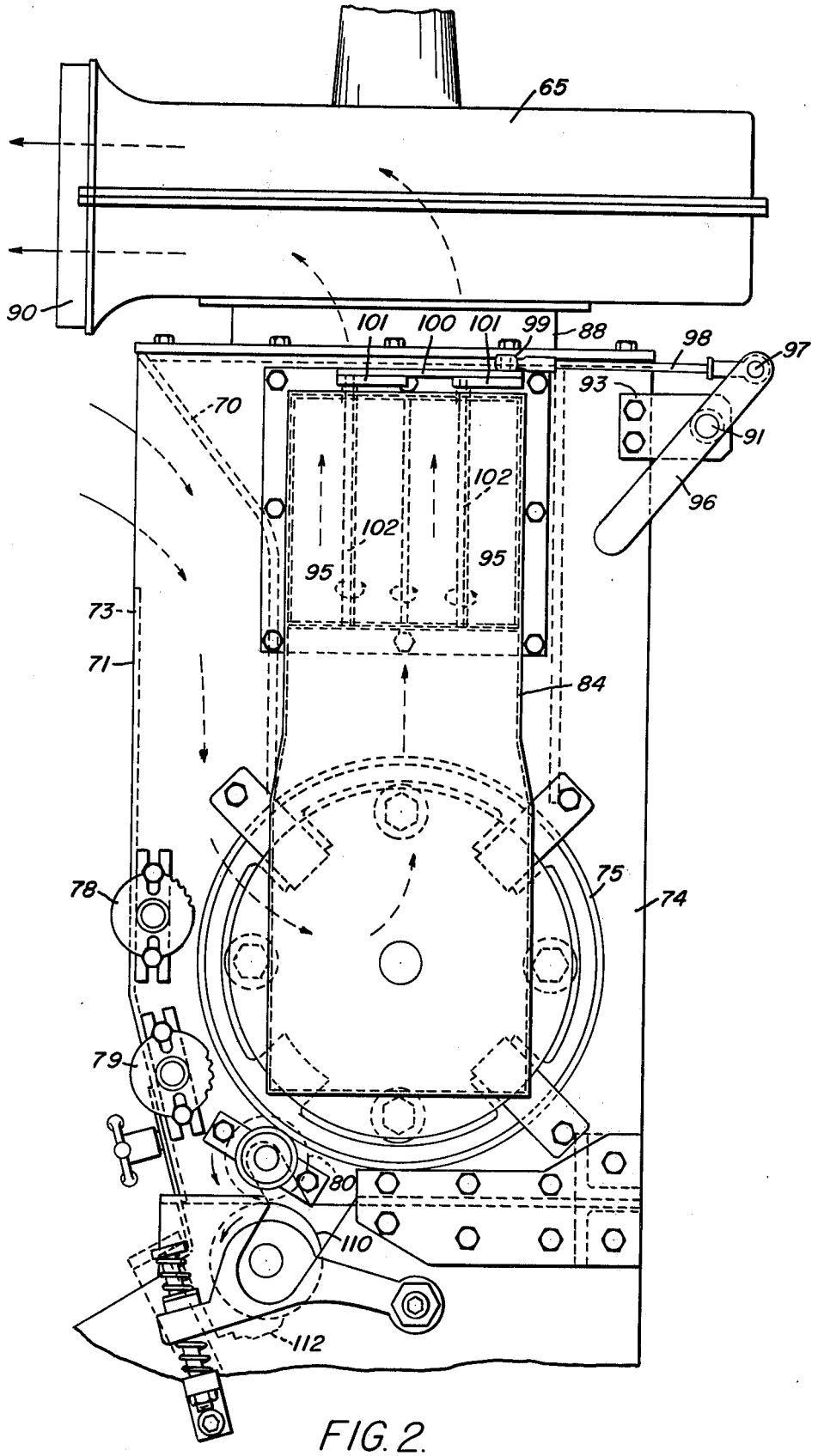
FIG. 2 is a vertical sectional view on an enlarged scale illustrating further the condenser fan section of the machine.

The suction fan draws the fibers through the chute and onto the rotating foraminate feeder condenser 75, which may be of conventional construction, and which rotates on a shaft 72 journaled in the screen box 74. Adjacent to condenser 75 and positioned to cooperate therewith in forming a feed mat are rollers 78, 79, and 80 (FIG. 2). The air is drawn over the pins 52 through duct 67 and chute 73 so that the fibers are compacted between the rotary condenser 75 and the wall 71 of the chute.

Figure 3:
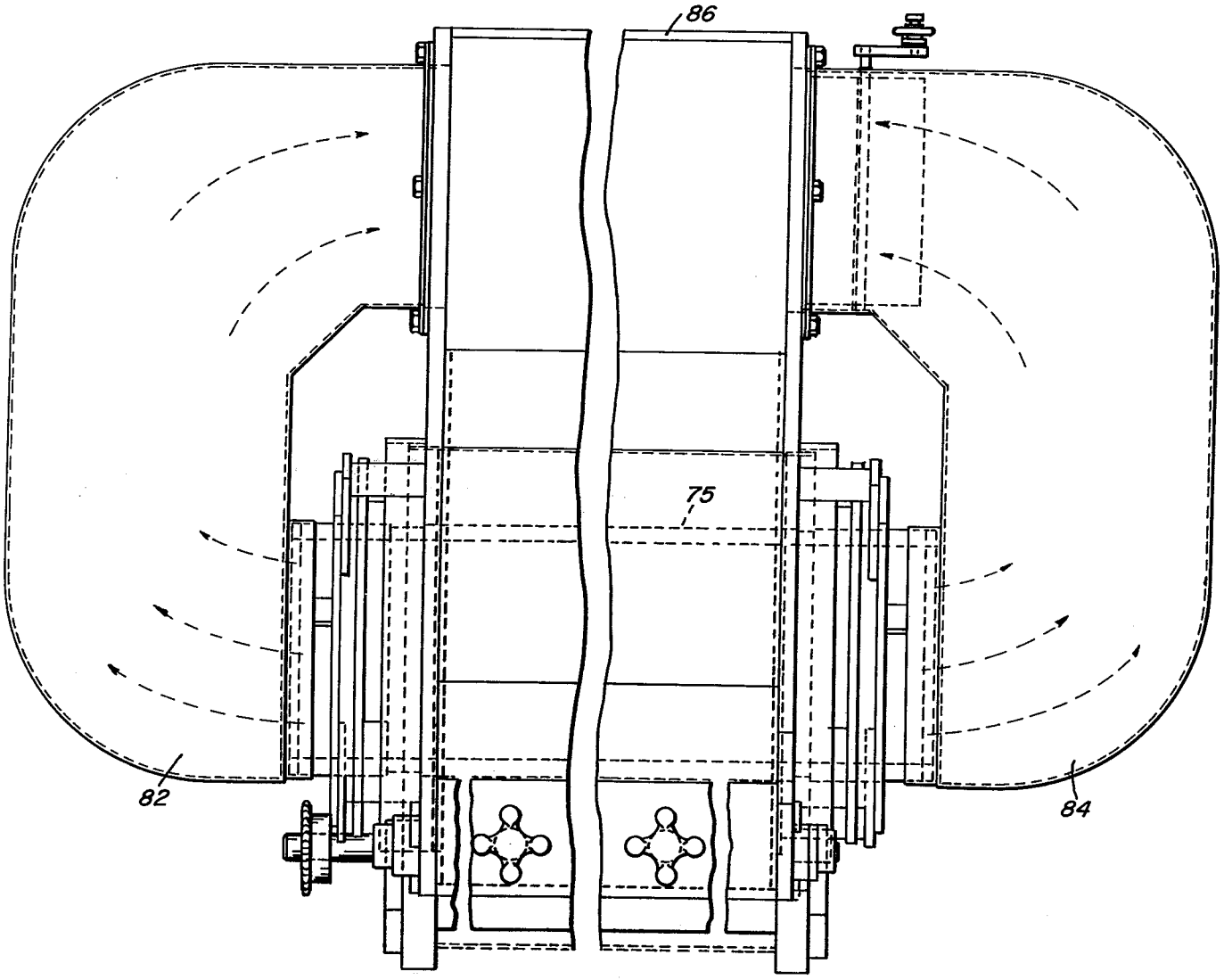
FIG. 3 is a fragmentary sectional view at right angles to the view of FIG. 2.

The condenser is open at both ends and its opposite ends are connected by ducts 82, 84 (FIG. 3), respectively, to a manifold or plenum chamber 86, which is open at its upper end and which is connected by the short duct 88 with the housing 65 and the suction fan that is contained within that housing. The fan exhausts through the opening 90 at one end of the housing to atmosphere. The fan is driven from a motor (not shown) through a pulley 92 (FIG. 1) which is secured to a shaft 94, which drives a worm (not shown), or other suitable gearing connected with the fan.

The feed section of the machine is supported on rollers 124 (FIG. 1) which roll on guide rails 126 secured on the cover plate 128 of the base of the machine.

The velocity of movement of the air through the fiber chute is controlled by adjustable damper blades 95 (FIG. 2), that are pivotally mounted in the plenum chamber, and that are adjustable by manipulation of lever 96 which is pivotally mounted at 91 on a bracket 93 that is secured to the screen box 74. Lever 96 is pivotally connected at 97 to one end of an operating rod 98 that is pivotally connected at 99 to a bar 100 that, in turn, is pivotally connected by arms 101 to the hinge pins 102 on which the damper blades 95 are mounted.

Figure 4:
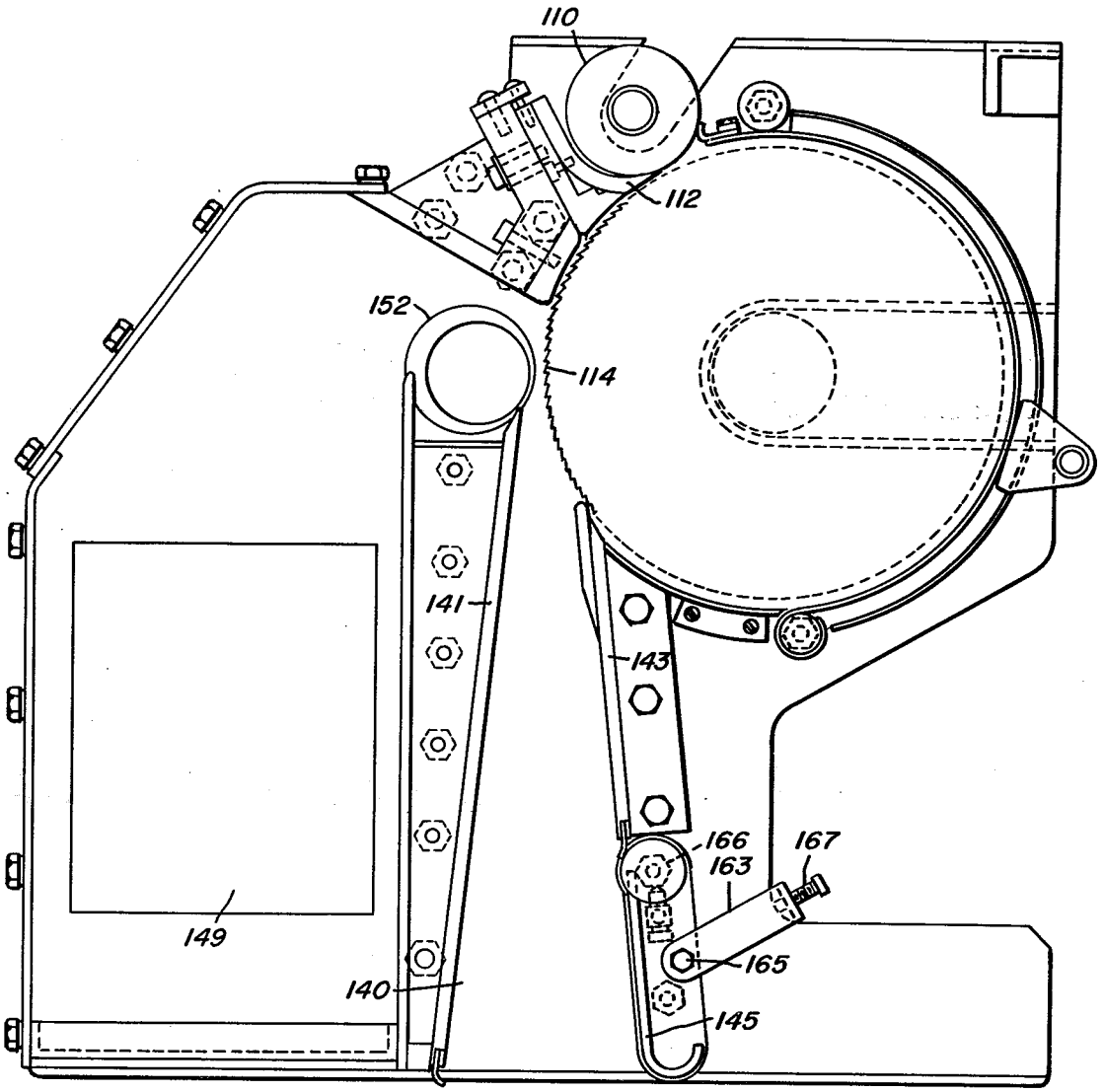
FIG. 4 is a vertical sectional view on the scale of FIG. 2 showing the lickerin and the duct for conveying fibers from the lickerin to the webber condenser of the machine.

The mat of fibers is doffed from the feeder condenser 75 by the doffing roll 80, and delivered into the nip between a conventional feed roll 110 and a conventional feed plate 112, conventionally mounted. The feed roll feeds the mat of fibers over the nose of the feed plate to a lickerin 114 (FIG. 4), which is of conventional construction, and which rotates at high speed and combs fibers from the mat.

The fibers are carried from the chute 73 (FIG. 1) to the feed plate 112 by an air bridge produced by the suction of a webber fan 120 (FIG. 5), which is mounted in a housing 121 in the base of the machine beneath the feeder mechanism. The webber fan 120 is driven by a motor 130 (FIG. 1), that is mounted in the base of the machine, through pulley 132, belt 134, and pulley 136. The pulley 136 is secured to the drive shaft 138 of the fan.

The fan 120 produces an air stream that moves tangentially past the lickerin 114 so that the fibers combed by the lickerin from the feed mat are doffed from the lickerin by centrifugal force and the air stream, and are carried into the duct 140 (FIG. 4) that delivers them onto the horizontal foraminate condenser belt 142 (FIG. 1). Duct 140 is bounded by walls 141 and 143.

Figure 5:
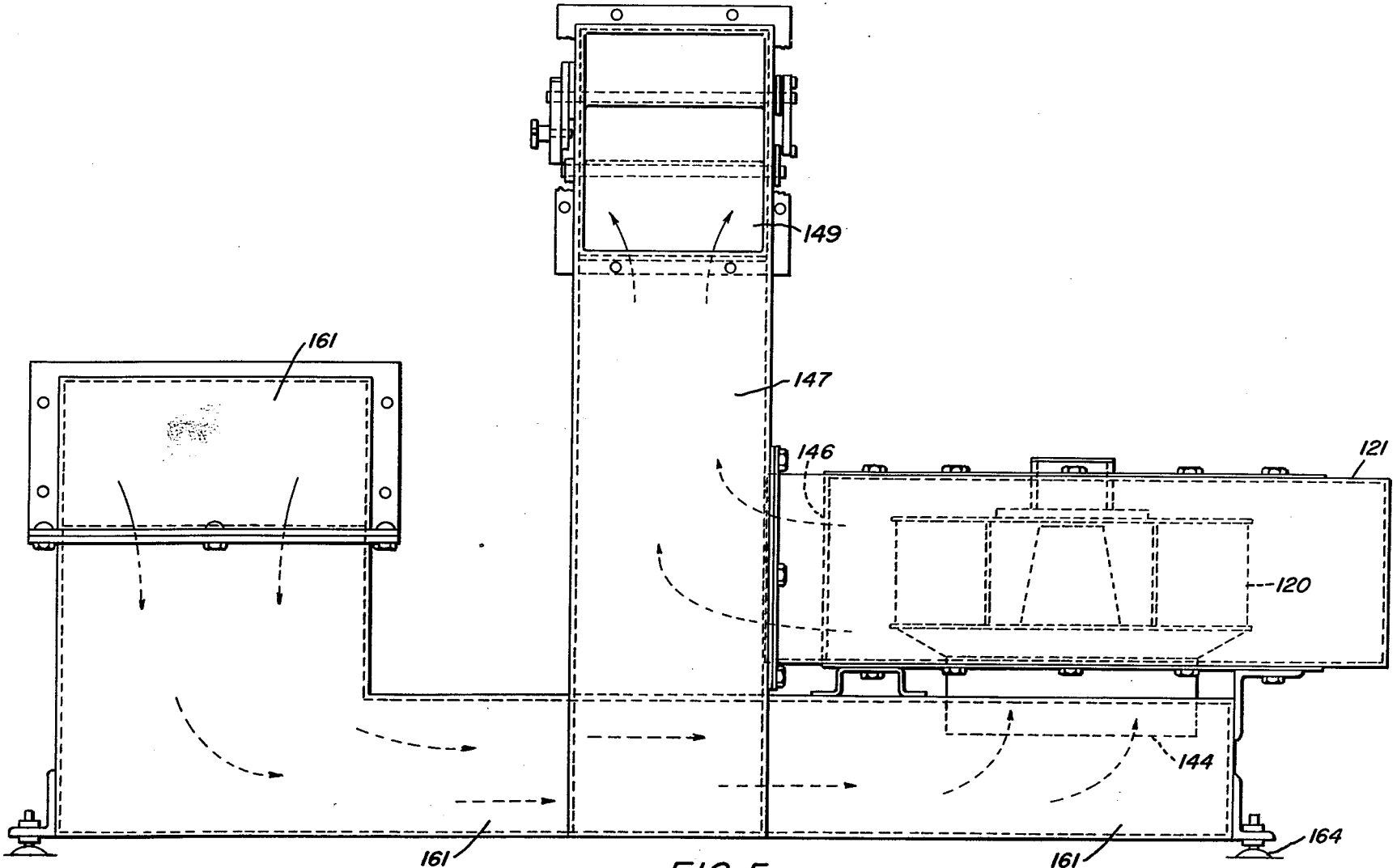
FIG. 5 is an enlarged side elevation of the main fan duct section of the machine, parts being broken away.

The air is sucked through condenser belt 142 by the fan 120 and is returned by the recirculation duct 161 (FIG. 5) to the fan inlet opening at 144 (FIG. 5). The air is exhausted from the fan 120 at the outlet opening 146 and passes through a duct 147 and a duct 149 into housing 150 (FIG. 1) where it passes over a saber 152 (FIGS. 1 and 4) and tangentially downwardly past the teeth of the lickerin, being recirculated through duct 161, thereby to doff further fibers from the rotating lickerin. The saber, which is a roller journaled eccentrically in the sides of the condenser-fan unit, serves to aid in doffing the fibers from the lickerin. The eccentric mounting of the saber allows of varying the space between the lickerin and the saber.

The condenser 142 (FIG. 1) is driven by a motor 153 through a pulley or sprocket 155, a belt or chain 157, and a pulley or sprocket 159. The pulley or sprocket 155 is mounted on the armature shaft of the motor 153; and the pulley or sprocket 159 is mounted on a shaft on which a roller or sprocket 151 is secured. Condenser 142 travels over this roller or sprocket and over a parallel roller or sprocket 148.

The lower section 145 (FIG. 4) of the wall 143 of the duct 140 is adjustable to control the width of the discharge end of this duct. This lower section 145 is pivoted at 166 on the feeder frame, and is adjusted by an arm 163 which is pivotally connected to this lower section at 165, and which is adjustable by a screw 167 which threads into the lower portion of the lickerin frame.

It is to be noted that the axes of the feeder condenser 75 and of the lickerin 114 lie in the same vertical plane and that this plane is perpendicular to the upper reach of the webber condenser 142 so that the flow of the fibers from the feeder condenser to the lickerin and thence to the webber condenser is with gravity, and that the web formation is at right angles to the vertical feed system.

The disposition of the feeder on top of the base of the webber, and the vertical arrangement of the feeder condenser and the lickerin combine to require a minimum space for the combined feeder-webber. Moreover, this compact arrangement of the feeder and webber minimizes the cost of the combined machinery.

The feeder table 160, on which the motor 130 and webber fan housing 121 are mounted, and the webber table 162 above which the lower reach of the webber condenser belt 142 travels, are supported between the legs 122 on which the plates 128 and 129 that support the feeder and the upper portion of the webber are mounted. The legs are carried on adjustable feet 164 which permit leveling the machine.

The web laid down on the upper reach of the condenser belt 142 may be carried from the webber section of the machine by this belt and delivered between the rotating knives 170 of a conventional slitter 174. This machine forms no part of the present invention.

The slitting knives are driven from a motor 176, that drives knives 170 through a pulley 177, a belt 178 and a pulley on shaft 179. The web travels between knives 170 and a roller 171. This roller is adjustable toward and from the knives by mechanism denoted generally at 172 forming no part of the present invention. The web travels over rollers 181 and 182. On the shaft 179 there is a pulley which drives a pulley on the shaft that carries roller 182. A gear, which is mounted on shaft 179 meshes with a gear on the shaft of roller 181; and this shaft drives a fan 184 through pulleys 186 and 187 and belt 185. Fan 184 supplies air through duct 188 to hopper 25 through the port 189 in the hopper. This air prevents the fibrous material in the hopper from matting.

Mounted on top of the feeder may be an anti-static system 190, which may comprise a storage tank, a pipe 192 for drawing water out of the tank, and a spray unit 194 for delivering a spray into the feeder to humidify this unit to an extent to offset static. A valve 196 may be provided to control the spray.

In the machine of FIGS. 6 to 9 inclusive, the fibers are delivered by a conventional pneumatic delivery system from a conventional opener, for instance, into a chute 200 in which is mounted a level control lever 202 and from which the fibers are fed by the two oppositely rotating chute feed rolls 204 and 206 onto an endless floor apron or conveyor belt 208 similar to the belt 32 of the first described embodiment of the invention, and on which are secured a plurality of preferably wooden slots 210. These slots are provided with pins 212 which pick up the tufts of fibers delivered into the bin 214 by the chute 200. The apron 208 is mounted to travel over pulleys 216 and 218 which are secured to shaft 220 and 222, respectively, that are journaled in the sides of the bin.

This apron carries the stock material from beneath the chute 200 to an endless elevating apron or conveyor 224, which is mounted to travel over pulleys 226 and 228 that are secured to shafts 230 and 232, respectively, also journaled in the sides of the bin 214. The elevating apron is provided with a plurality of spaced straps 234 in which are embedded pins 236. These pins pick up tufts of fibers from the floor apron 208; and they carry these tufts upwardly toward the top of the bin 214 as the belt 224 travels upwardly.

A container 238 is disposed adjacent the right-hand end of the conveyor 208 to catch dirt and trash picked up by this conveyor and a stripper 240 is disposed just above this end of this conveyor to aid in removing trash from this conveyor and deflecting it into the container 238. A clean-out door (not shown) may be provided at one end of this container through which the collected dirt and trash can be removed from the container.

Mounted in the upper portion of the bin to cooperate with the elevating apron 224 is an endless stripping apron 242. This apron travels over pulleys 244 and 246 that are secured to shafts 248 and 250, respectively, which are also journaled in the sides of bin 214. The apron 242 carries a plurality of straps 252 in which are embedded pins 254. The stripping apron breaks up and reduces the tufts of material, which are carried upwardly by the pins 236 of the elevating apron, and removes excess material from the elevating apron, delivering the excess back into the bin.

A plate 256 pivoted at 258 on the sides of the bin keeps the fibers delivered into the bin in contact with the apron 208.

The tufts remaining on the pins 236 of the elevating apron are stripped from these pins by suction. A suction fan (not shown) of conventional construction mounted in a housing 260 and driven by a motor 262 sucks the tufts of fibers off of pins 236 into a duct 264. Air is admitted to the duct through openings 266 in the sides of an inverted drum-like protrusion 268 on the top of bin 214. Apertures 270 in an extension of this top wall also admit air to duct 264. The amount of air admissable through the apertures 270 is controlled by a slide 272 which may be adjusted to clear or close one or more of these apertures.

The tufts of fibers carried by the air stream flowing through duct 264 are carried through the trumpet 274 around a rotary feeder condenser 276. The trumpet is bounded on one side by a knee 280, that projects down into bin 282, and on the opposed side by an endless screen 278 that travels around the foraminate periphery 284 of the condenser and over the drive roller 286. Roller 286 is journaled on a shaft 288 mounted in opposed sides of bin 282. Air is sucked into the condenser through the opening 290 in its perimeter, causing fibers to be drawn out of the air stream in the trumpet section 274 and to be deposited as a mat on the condenser.

The air is sucked through the duct 292 which extends axially through the condenser out both ends thereof into ducts 294 which empty into a vacuum expansion chamber 296 from whence the air is sucked by the fan in housing 260. The open or exhaust end 296 of housing 260 is connected to a dust collection system.

A doffing bar 298 doffs the mat from the condenser; and a feed roll 300 feeds the mat over the nose bar 302 of knee 280 to the rotating lickerin 303. Feed roll 300 is journaled on shaft 304; and the lickerin is rotatably mounted by shaft 306.

Figure 7:
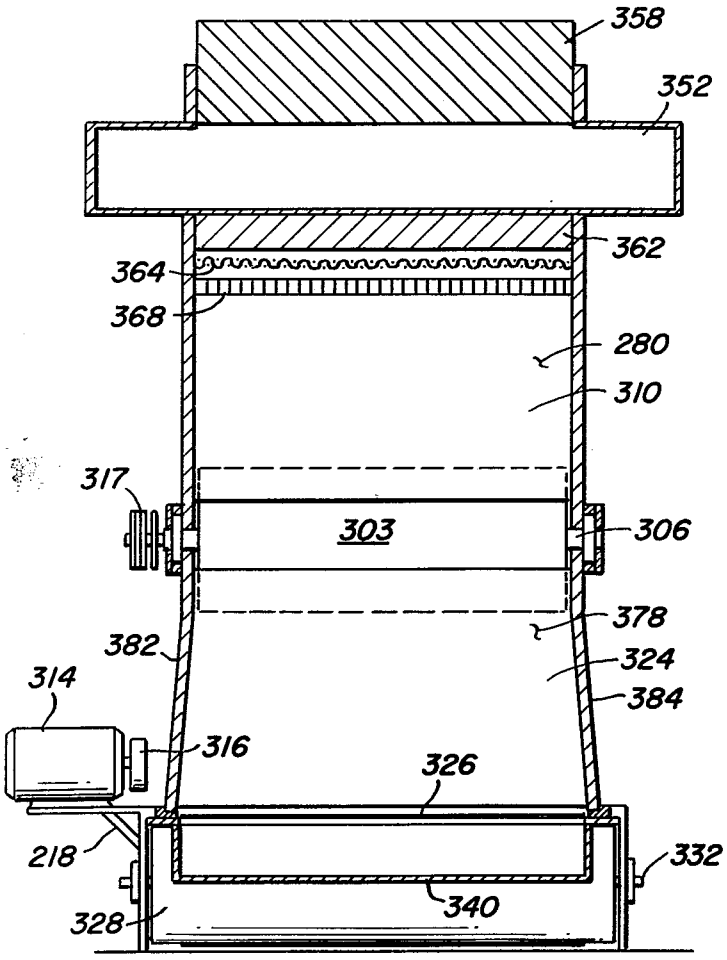
FIG. 7 is a section through this machine taken on the line 7—7 of FIG. 6.

The lickerin may be driven by a motor 314 through a conventional pulley or a sprocket and chain drive, the drive member of which is shown at 316 and the driven member at 317 in FIG. 7. The motor is mounted by a bracket 318 on the base of the machine.

The lickerin in its rotation combs with its teeth 305 (FIG. 8) the fibers from the mat fed to it over the nose bar; and those fibers are doffed from the lickerin by centrifugal force and by an air stream flowing through the venturi section 308 of a duct 310 which is bounded on one side, above the lickerin, by the knee 280 and on the opposite side by the wall 312 of the bin 282. A cover 323 encloses the major portion of the periphery of the lickerin. An eccentrically-mounted, rotatably adjustable saber tube 320 mounted in the wall section 322 of bin 282 opposite the lickerin adjustably controls the width of the venturi section 308 of duct 310.

The fibers doffed from the lickerin are carried by the air stream flowing past the lickerin into a duct or condensing chamber 324 of gradually expanding width, and deposited on an endless screen conveyor 326 that travels over rollers 328 and 330 mounted on rotatable shafts 332 and 334, respectively.

Air is sucked through the foraminate conveyor 326 by a fan 336 which is driven by a motor 338. The air is sucked into a vacuum box 340, mounted in the base of the machine between the upper and lower reaches of conveyor 326, through a perforate diffuser 342 into a box 344, and thence through twin conduits 346 which communicate with box 344 at opposite sides thereof. The ducts 346 communicate with a vacuum expansion chamber 348 from which the air is sucked by fan 336 and delivered through duct 350 and an air distribution tube 352 into a distribution chamber 354.

The tube 352 has a longitudinally-extending slot in it through which the air flows into chamber 354. A vertically adjustable blade 358 that is mounted to slide in the top wall 360 of chamber 354 controls the flow of air from tube 352. When this blade is extended into the slot 356 in tube 352 it splits the air flowing from the tube into two streams and causes this air to swirl about in chamber 354. A nose piece 362 secured to the bottom of the tube further divides the air stream and directs it into a screen 364, which extends across chamber 354 near the bottom thereof. A handle 366 is secured to blade 358 to effect its adjustment.

The air is sucked from the chamber 354, in a closed recirculating circuit back to fan 336. The fan drives the air through the screen 364 and a perforate diffuser 368 extending over the bottom of the chamber into the velocity improvement chamber 310. This chamber is bounded by the curved, downwardly converging wall 312 and the opposed curved wall 370 of knee 280.

An adjustable atmospheric air inlet is provided in wall 312 just above saber 320 to control the rate of air flow through the venturi section 308 of the duct 310. This inlet comprises the apertures 372 in the wall and the manually adjustable slide 374 which is adjustable on the outside of the wall to open or close the apertures 372 through which atmospheric air can flow into the duct.

A further adjustable atmospheric air inlet to duct 310 is provided below the lickerin 302. This also comprises apertures 376 in the lower wall 378 of duct 310, which bounds at one side condensing chamber 324. A slide 380 in the outside of this wall enables the amount of atmospheric air admitted through apertures 376 to be controlled.

Wall 378 may be stationary but opposed wall 322 of the condensing chamber 324 is pivotally mounted around saber 320 for angular adjustment toward and from wall 378. This adjustment allows control of the width of the condensing chamber and of the divergence downwardly of these walls in one direction. The other two walls 382 and 384 of this chamber also diverge from one another downwardly to product condenser 326. A roller 386 carried on the bottom of wall 322 controls the thickness or weight of the web W formed on the product condenser. A coil spring 388 keep this roller pressed against the web.

A doffing bar 390 is secured to the wall 378 to aid in doffing fibers from the lickerin 303. As an example of what the apparatus illustrated in FIGS. 6, 7 and 8 can do a 45 inch wide nonwoven web structure was formed. For this purpose, the fibrous material used was 1½ denier 1 9/16 inch long staple polyester fiber, opened via Curlator Corporation's RANDO-Opening equipment and pneumatically fed into the rear of the feeder. The feeder constructed a feed mat of 14 ounces per square yard which was fed to the lickerin 303 via the feed roll 300 and nose bar 302. A 12 inch diameter lickerin having a metallic covering of 40 teeth per square inch was used, each tooth having a projected height above the lickerin surface of 0.156 inches and 0.025 inch thick with a forward rake of 40°. The clearance between lickerin teeth and the nose bar working point was maintained at 0.007 inch while the distance between the lickerin and the nose bar tail was set at 0.015 inches. The lickerin rotated at 6000 RPM and projected a uniform stream of fibers into the venturi area 308 at an initial uniform velocity of 18,600 feet per minute. The average air velocity at the inlet of the venturi section just prior to the mixing zone of input air and fiber was 14,500 feet per minute and increased into the venturi to 22,300 feet per minute with a turbulence intensity of 0.5%. The velocity profile across the cross-sectional area of the venturi had a gradient of less than 1% per 30 CM of width excluding the wall attachment effects at the outer extremities of this area.

Since the inlet velocity into the expansion chamber was subsonic the velocity through the chamber decreased as the distance increased; however the temperature increased. The air pressure remained almost constant throughout the chamber to the condensing area. The dimension of the input duct just prior to the fibrous projection point was 2 inches in depth, the minimum depth below the point of maximum projection of the lickerin into the venture was 1 5/16 inches, the distance between the walls at the entrance of the expansion chamber just below the doffing blade was 1 11/16 inches and at the point just above the condenser screen the width between the walls or covers was 2 9/16 inches; the final velocity here was 11,300 feet per minute.

The following production rates were obtained at a web weight of 1 ½ounces per square yard:

| FEET PER MINUTE | POUNDS PER HOUR PER INCH |
|---|---|
| 125 | 6.5 |
| 150 | 7.8 |
| 175 | 9.1 |
| 200 | 10.4 |

Figure 6:
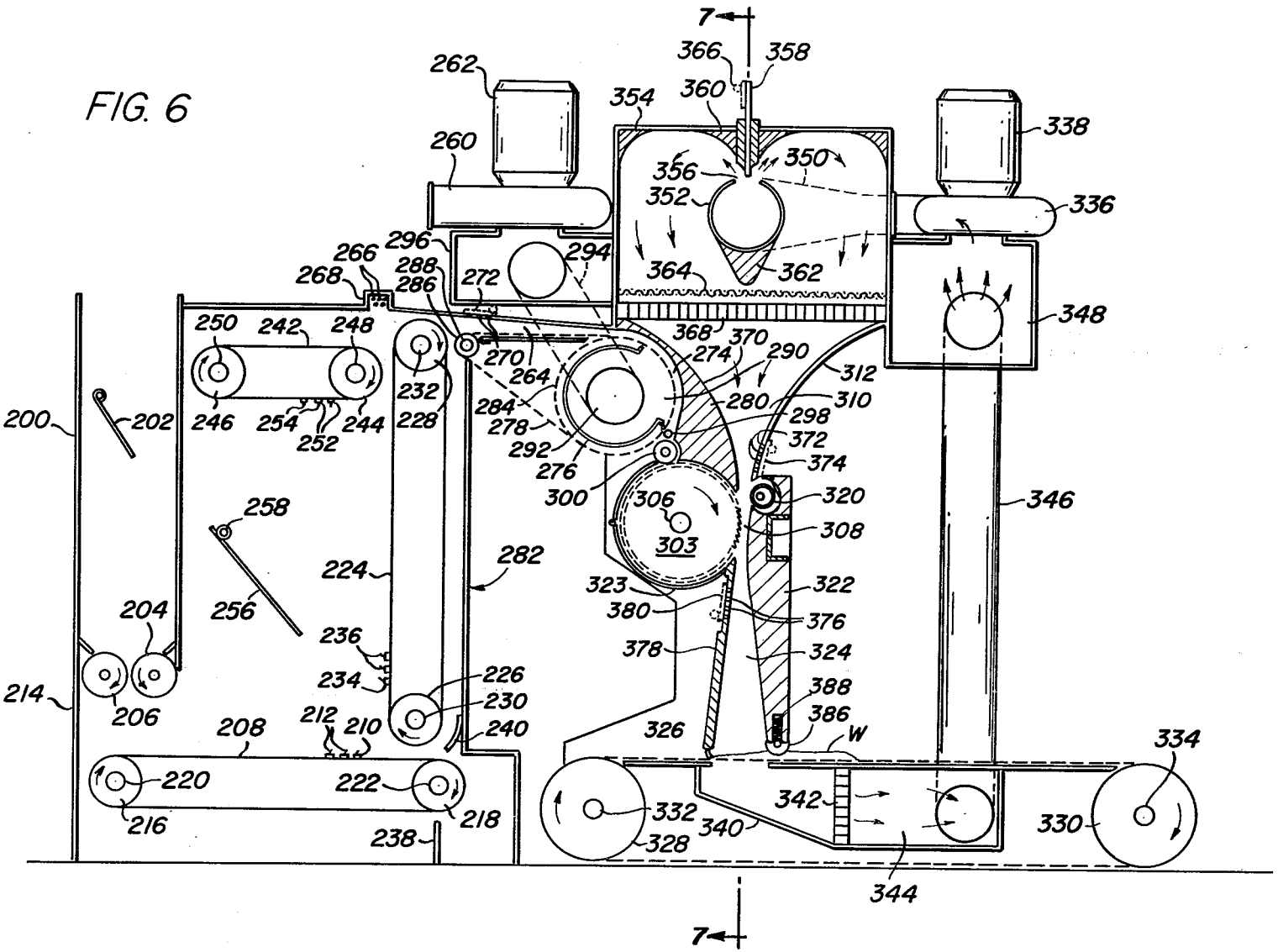
FIG. 6 is a somewhat diagrammatic vertical longitudinal sectional view of a combination fiber feeding and web-forming machine built according to a second embodiment of the invention.
Figure 8:
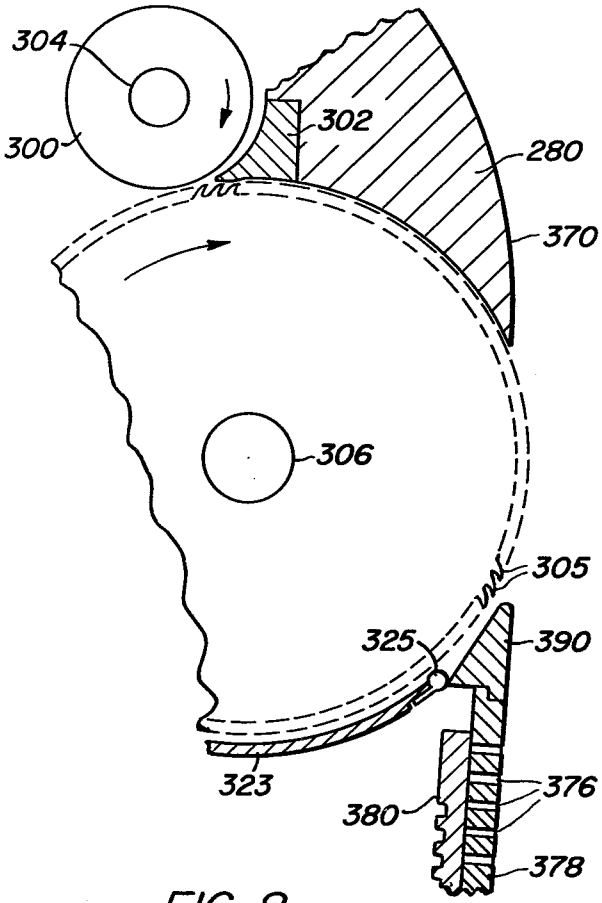
FIG. 8 is a greatly enlarged fragmentary view showing the feed roll, feed plate, lickerin, pressure air chamber and doffing bar of this machine.

In the machine of FIGS. 6, 7 and 8, the feed mat of fibrous materials conveyed to the web forming unit by the feeder should not exceed 14 ozs. per square yard for the Example given. The inlet air to the WEBBER is provided by a fan 336 through a duct system 350 which ejects a uniform flow of air from a centrally located tube 352 and adjustable slot means 356, 358 at the inlet chamber 354 so that air expands from the supply tube to both sides of the chamber. The distribution screens 364, 368 provide a uniform flow substantially free from turbulence and vortices. The fibrous flow is in a vertical aspect. The web formation is in a horizontal aspect. The doffing bar 390 should be set between 0.007 inch and 0.010 inch from the teeth of the lickerin 303. The vertical center line of the machine is the tangent line to the outer edge of the lickerin and at right angles to the condenser 326. The outer edge of the nose bar tail 302 is set away from the center line and above the lickerin by a distance of not more than 17 mm.

Previous aerodynamic web forming equipment with a fibrous stream at an angle to the horizontal, such as the RANDO-WEBBER, usually have between 12° and 25° downward flow from the horizontal from the lickerin to the condenser, have a lickerin cylinder which protrudes excessively into the air flow stream over the saber and hence cause unstable and nonuniform regions of air flow which are advanced to the condenser and cause unstable eddies upstream from the condenser surface and also cause unstable back pressure flow across the venturi section. It is important that the lickerin only protrude into the air stream by an amount necessary to strip the boundary layer surrounding the cylinder's surface; and this is normally between 1/16 and ½ of an inch projection.

While the invention has been described in connection with specific embodiments thereof, it will be understood that it is capable of further modification, and this application is intended to cover any modifications or adaptations of the invention which come within its scope or the limits of the appended claims.

Having thus described my invention what is claimed is:

1. In a machine for forming random fiber webs, having a first rotary foraminate condenser, means for delivering airborne fibers onto said first condenser to form a fiber mat on said first condenser, a rotary lickerin mounted beneath said first condenser, means for doffing the mat from said first condenser and feeding the mat to the lickerin so that the lickerin in its rotation combs fibers from the mat, a cylindrical saber mounted in spaced, confronting relation to said lickerin to assist in doffing fibers therefrom, and an endless foraminate condenser whose upper reach at least travels in a horizontal plane beneath said lickerin, the improvement comprising a pair of tapered, vertically disposed ducts positioned one above the other with their narrow ends opening on the space between said lickerin and said saber, said space forming a venturi section between said ducts, and the lower of said pair of ducts extending from said venturi section to and above the upper reach of the last-named condenser, pneumatic means for creating a high velocity air stream in said lower duct to doff fibers from said lickerin and to convey the doffed fibers in a vertically downward direction onto the upper reach of said last-named condenser, said pneumatic means including means for recirculating said air stream downwardly through the upper of said ducts and tangentially past said lickerin and into the upper end of said lower duct, after the stream has passed through the upper reach of said last-named condenser, and means for controlling the air flow in said ducts to minimize turbulence in said lower duct, including means eccentrically mounting said saber for rotational adjustment selectively to vary the distance between said saber and said lickerin, and means for controlling the supply of air to said ducts.

2. A machine as claimed in claim 1, wherein said lower duct is rectangular in configuration and has a gradually increasing cross sectional area downwardly from said lickerin to said last-named condenser to provide an expansion chamber at least one side of which is mounted for pivotol adjusment to control the width of the discharge end of the lower duct.

3. A machine as claimed in claim 2, wherein each pair of opposed walls of said lower duct diverge downwardly to said last-named condenser and form said expansion chamber.

4. A machine as claimed in claim 1 wherein said recirculating means includes an expansion chamber, a slotted air distribution tube connected to said expansion chamber, and a distribution chamber in which said tube is mounted and into which air flows through the slot in said tube, said upper duct communicating at its upper end with said distribution chamber.

5. A machine as claimed in claim 4, wherein a perforate diffuser is mounted in said distribution chamber adjacent the upper end of said upper duct.

6. A machine as claimed in claim 5, wherein said distribution chamber is of large cross-sectional area adjacent said diffuser and is of venturi formation below said large cross-sectional area and opposite said lickerin.

7. A machine as claimed in claim 1, wherein a doffing bar is mounted in operative relation to said lickerin, said air flow controlling means included a plurality of air inlet slots provided in one wall of said lower duct adjacent the doffing bar, and means is provided for adjustably controlling the area of opening of said inlet slots into said lower duct.

8. A machine as claimed in claim 1, wherein said lower duct has one wall thereof mounted adjacent its upper end for pivotal adjustment about an axis parallel to the axis of rotation of said lickerin.

* * * * *